United States Patent [19]

Reitner

[11] 4,239,398

[45] Dec. 16, 1980

[54] DEVICE FOR ATTENUATING NOISE EMITTED TO THE ENVIRONMENT BY NOISE-GENERATING AGGREGATES HAVING SIMULTANEOUS DISSIPATION OF HEAT

[75] Inventor: Wilhelm Reitner, Taufkirchen, Fed. Rep. of Germany

[73] Assignee: Siemens Aktiengesellschaft, Berlin & Munich, Fed. Rep. of Germany

[21] Appl. No.: 923,994

[22] Filed: Jul. 12, 1978

[30] Foreign Application Priority Data

Sep. 5, 1977 [DE] Fed. Rep. of Germany ..... 2739886

[51] Int. Cl.[3] ..... B41J 3/12

[52] U.S. Cl. ..... 400/124; 400/690; 181/201

[58] Field of Search ..... 101/93.05; 181/201, 181/202, 205; 400/124, 689, 690, 690.1, 690.2, 690.3, 690.4

[56] References Cited

U.S. PATENT DOCUMENTS

| | | | |
|---|---|---|---|
| 3,770,092 | 11/1973 | Grim | 400/124 |
| 3,860,085 | 1/1975 | Gilbert et al. | 181/205 |
| 4,009,772 | 3/1977 | Glaser et al. | 400/124 |
| 4,044,668 | 8/1977 | Barrus et al. | 400/124 X |
| 4,135,830 | 1/1979 | Hishida et al. | 400/124 |

FOREIGN PATENT DOCUMENTS

| | | | |
|---|---|---|---|
| 496454 | 11/1938 | United Kingdom | 181/205 |

OTHER PUBLICATIONS

"The Performance of Acoustic Hoods at Low Frequencies", by R. S. Jackson, *Acustica*, vol. 12, No. 3, 1962, pp. 139–152.

*Primary Examiner*—Paul T. Sewell

*Attorney, Agent, or Firm*—Hill, Van Santen, Steadman, Chiara & Simpson

[57] ABSTRACT

A device for attenuating noise emitted to the environment by noise-generating aggregates, while simultaneously dissipating heat, provides a housing about the noise-generating aggregate, which housing comprises a pot-shaped capsule of noise-attenuating material and a cover of noise-attenuating material which seals the capsule. In addition, an arrangement, including heat-conducting material, is provided for promoting heat flow from the housing.

3 Claims, 4 Drawing Figures

DEVICE FOR ATTENUATING NOISE EMITTED TO THE ENVIRONMENT BY NOISE-GENERATING AGGREGATES HAVING SIMULTANEOUS DISSIPATION OF HEAT

BACKGROUND OF THE INVENTION

1. Field of the Invention

This invention relates to a device for attenuating noise emitted to the environment by noise-generating aggregates, the device simultaneously dissipating heat.

2. Description of the Prior Art

In many devices it is necessary that the noise emitted by noise-generating aggregates be attenuated in such a manner that the noise generated does not become excessive. An example of this in mosaic printers, in which characters are printed onto a paper web with the aid of needle recording heads which are moved in an oscillatory fashion. Usually, the recording head consists of a plurality of magnets, having armatures which carry the needles. In the recording operation, the armatures attracted by the magnets and moves the printing needle in the direction of the paper web. Following the printing process, the magnet is switched off and the armature can reassume its initial position, under the influence of a spring. This movement of the armature and the needle generates noise which are disturbing during operation.

SUMMARY OF THE INVENTION

The object of the present invention is to provide a device for attenuating noises emitted to the environment by such noise-generating aggregates.

This object is achieved in that the noise generating aggregate is provided in a housing which comprises a pot-shaped housing of noise-attenuating material and a detachable cover, also comprising a noise-attenuating material sealing the housing. In addition, an arrangement, including a heat-conducting material, is provided by which the heat of the aggregate can be conducted from the housing.

Advantageously, rubber can be selected as a noise-attenuating material.

The heat which is produced within the housing by the sealed arrangement of the noise-generating aggregate is reduced in that the noise-generating aggregate is surrounded by a shroud comprising heat-conducting material which, itself, is connected to a conduit of heat-conducting material, the conduit extending to the exterior of the arrangement.

BRIEF DESCRIPTION OF THE DRAWING

Other objects, features and advantages of the invention, its organization, construction and operation will be best understood from the following detailed description, taken in conjunction with the accompanying drawing, on which.

DESCRIPTION OF A PREFERRED EMBODIMENT

Figure 1:
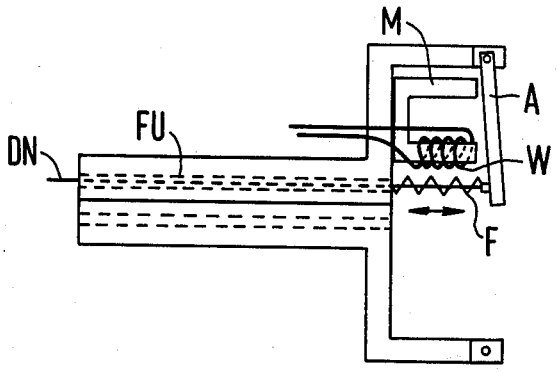
FIG. 1 is a fundamental illustration of a printing needle head.

Referring to FIG. 1, a fundamental embodiment of a printing needle head is illustrated, the printing needle head being merely an example of a noise-generating aggregate.

In the case of a printing needle head, as illustrated in FIG. 1, only one driving system for a printing needle is illustrated. It is apparent that a large number of these driving systems are provided in such a head.

A driving system can comprise a magnet M and an armature A. The printing needle DN is guided in a guide FU. The magnet M is attracted with the aid of a winding W which surrounds a side of the magnet. If a current is passed through such a winding W, the armature A is attracted to the magnet M, and the printing needle DN is moved toward the paper web, that is to the left in FIG. 1. Following the printing process, the current through the winding W is switched off and the armature A is brought into its initial position with the aid of a spring F.

Figure 2:
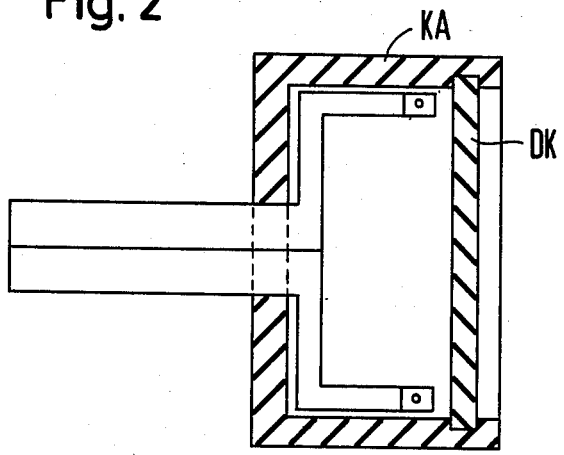
FIG. 2 illustrates an embodiment of a housing having a pot-shaped capsule and a cover for housing a noise-generating aggregate.

Noises which are disturbing during the printing operation are generated by the movement of the armature A and the movement of the printing needles. In order to attenuate the noises generated by the driving systems, the driving systems are arranged in a housing consisting of a pot-shaped housing KA of noise-attenuating material, e.g. rubber, which is sealed with a detachable cover DK also of noise-attenuating material, as illustrated in FIG. 2. The guide FU for the printing needles DN can extend out of the housing without noises of the driving system being permitted to escape to the exterior to a great extent. To this end, it is only necessary that the housing be permitted to closely adjoin the guides FU.

Figure 4:
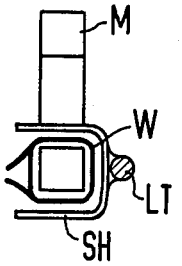
FIGS. 3 and 4 illustrate an arrangement for conducting heat from the housing.
Figure 3:
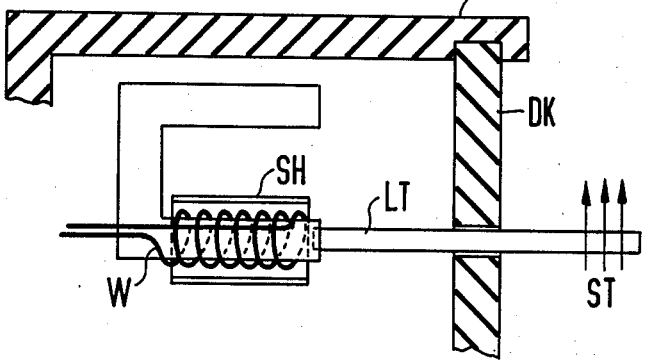

Inasmuch as the driving systems are entirely surrounded by the noise-attenuating housing, heat which could impair the operation of the driving system can be produced within the housing in order to avoid heat build-up, the driving system, in particular the winding W, can be surrounded by a shroud SH, as illustrated in FIGS. 3 and 4. The shroud SH may be bent in U-shaped fashion and can be disposed over the winding W, and may in fact be common to all of the windings of a plurality of magnet systems. The shroud consist of a heat-conducting material, such as copper. A conduit LT, also comprising heat-conducting material, is fixed to the shroud SH. This conduit LT can, for example, be extended out of the housing through the cover DK to the exterior of the housing, as illustrated in FIG. 3.

The shroud SH absorbs the excessive heat within the interior of the housing and transmits the heat to the conduits LT which discharge the heat from the housing. The conduit LT may be arranged outside the housing in a cooling air flow ST which receives the heat discharged from the interior of the housing.

Furthermore, a device constructed in accordance with the present invention has the advantage that the driving system is protected against pollution.

Although I have described my invention by reference to a particular illustrative embodiment thereof, many changes and modifications of the invention may become apparent to those skilled in the art without departing from the spirit and scope thereof. I therefore intend to include within the patent warranted hereon all such changes and modifications as may reasonably and properly be included within the scope of my contribution to the art.

I claim:

1. A device for the attenuation of noises emitted to the environment by a mosaic printer writing head and for simultaneously dissipating heat, comprising:

a plurality of magnet systems and respective printing needles, each of said magnet systems comprising a magnet, a pivotally mounted armature carrying a respective printing needle, and a winding about a portion of said magnet energizable to cause said magnet to attract said armature;

a pot-shaped housing of noise-attenuating material housing said plurality of magnet systems;

a cover of noise-attenuating material sealing said housing;

a U-shaped shroud of heat conducting material surrounding and common to all of said windings of said plurality of magnet systems; and a heat-conducting conduit comprising a heat-conducting line connected to said shroud and extending through and out of said housing.

2. The device of claim 1, wherein the noise-attenuating material is rubber.

3. The device of claim 1, wherein the heat-conducting material is copper.

* * * * *